US008978522B2

(12) United States Patent
Hsieh

(10) Patent No.: US 8,978,522 B2
(45) Date of Patent: Mar. 17, 2015

(54) WRENCH

(71) Applicant: Kabo Tool Company, Taichung (TW)

(72) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 214 days.

(21) Appl. No.: 13/735,025

(22) Filed: Jan. 6, 2013

(65) Prior Publication Data

US 2013/0269489 A1 Oct. 17, 2013

(30) Foreign Application Priority Data

Apr. 13, 2012 (TW) ..... 101113280 A

(51) Int. Cl.
*B25B 13/06* (2006.01)
*B25B 13/08* (2006.01)
*B25B 13/04* (2006.01)

(52) U.S. Cl.
CPC ..... *B25B 13/06* (2013.01); *B25B 13/08* (2013.01); *B25B 13/04* (2013.01)
USPC ..... 81/124.4; 81/125.1

(58) Field of Classification Search
CPC ..... B25B 13/04; B25B 13/06; B25B 13/08; B25B 23/0007
USPC ..... 81/124.4, 125.1, 119
See application file for complete search history.

(56) References Cited

U.S. PATENT DOCUMENTS

| | | | | | |
|---|---|---|---|---|---|
| 1,261,565 | A * | 4/1918 | Leitner | 81/125.1 |
| 1,393,399 | A * | 10/1921 | Schlehr | 81/418 |
| 2,332,602 | A * | 10/1943 | Rosenbloom | 81/125.1 |
| 2,687,056 | A * | 8/1954 | Foor | 81/125.1 |
| 3,931,749 | A * | 1/1976 | Evans | 81/119 |
| 6,715,383 | B1 * | 4/2004 | Hsien | 81/119 |
| D514,405 | S * | 2/2006 | Chaconas | D8/25 |
| 7,117,770 | B2 * | 10/2006 | Hsien | 81/186 |
| 7,926,393 | B2 * | 4/2011 | Hart | 81/124.4 |
| 8,459,153 | B2 * | 6/2013 | Abel | 81/119 |
| 8,474,352 | B2 * | 7/2013 | Eggert et al. | 81/119 |
| 8,613,240 | B2 * | 12/2013 | Feraud et al. | 81/119 |
| 2009/0301270 | A1 * | 12/2009 | Hart | 81/124.3 |
| 2010/0229695 | A1 * | 9/2010 | Hart | 81/124.3 |
| 2010/0275739 | A1 * | 11/2010 | Hart | 81/124.4 |
| 2011/0239830 | A1 * | 10/2011 | Abel | 81/119 |
| 2013/0269490 | A1 * | 10/2013 | Hsieh | 81/125.1 |

* cited by examiner

*Primary Examiner* — David B Thomas
(74) *Attorney, Agent, or Firm* — CKC & Partners Co., Ltd.

(57) ABSTRACT

A wrench includes a handle, a first driver and a second driver. The first driver and the second driver are integrally connected to the ends of the handle respectively. One opening end of the first driver and one opening end of the second driver are horizontally connected to two ends of the handle respectively. The second driver is hollow tube-shaped and has a plurality of first teeth and a plurality of second teeth located on an inner wall thereof. Two angles are between two opening ends of the second driver and the first teeth and the second teeth respectively, and the angles are from 75 degrees to 105 degrees.

5 Claims, 4 Drawing Sheets

WRENCH

RELATED APPLICATIONS

The application claims priority to Taiwan Application Serial Number 101113280, filed Apr. 13, 2012, which is herein incorporated by reference.

BACKGROUND

1. Technical Field

The present invention relates to a hand tool. More particularly, the present invention relates to a wrench with two drivers at two ends thereof.

2. Description of Related Art

A conventional wrench has two drivers at two ends thereof for driving different components. However, the conventional wrench has one type of teeth but located on the driver with different angles for cooperating with different locking positions and device. Although one drivers of the conventional wrench can drive one tooth-type component with only one angle, it exists difficult on adjusting the handling posture of a user when on different locking position or other devices. Furthermore, the wrench also cannot lock the components at different positions.

SUMMARY

According to one aspect of the present disclosure, a wrench includes a handle, a first driver, and a second driver. The first driver is integrally connected to an end of the handle, and an opening end of the first driver is horizontally connected with the handle. The second driver being hollow tube-shaped is integrally connected to the other end of the handle, and an opening end of the second driver is horizontally connected to the handle. The second driver has a plurality of first teeth and a plurality of second teeth, and the first teeth and the second teeth are located on an inner wail of the second driver. An angle α is formed between the first teeth and the opening end of the second driver, and an angle β is formed between the second teeth and the other opening end of the second driver, wherein the angle α and the angle β are both from 75 degrees to 105 degrees.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
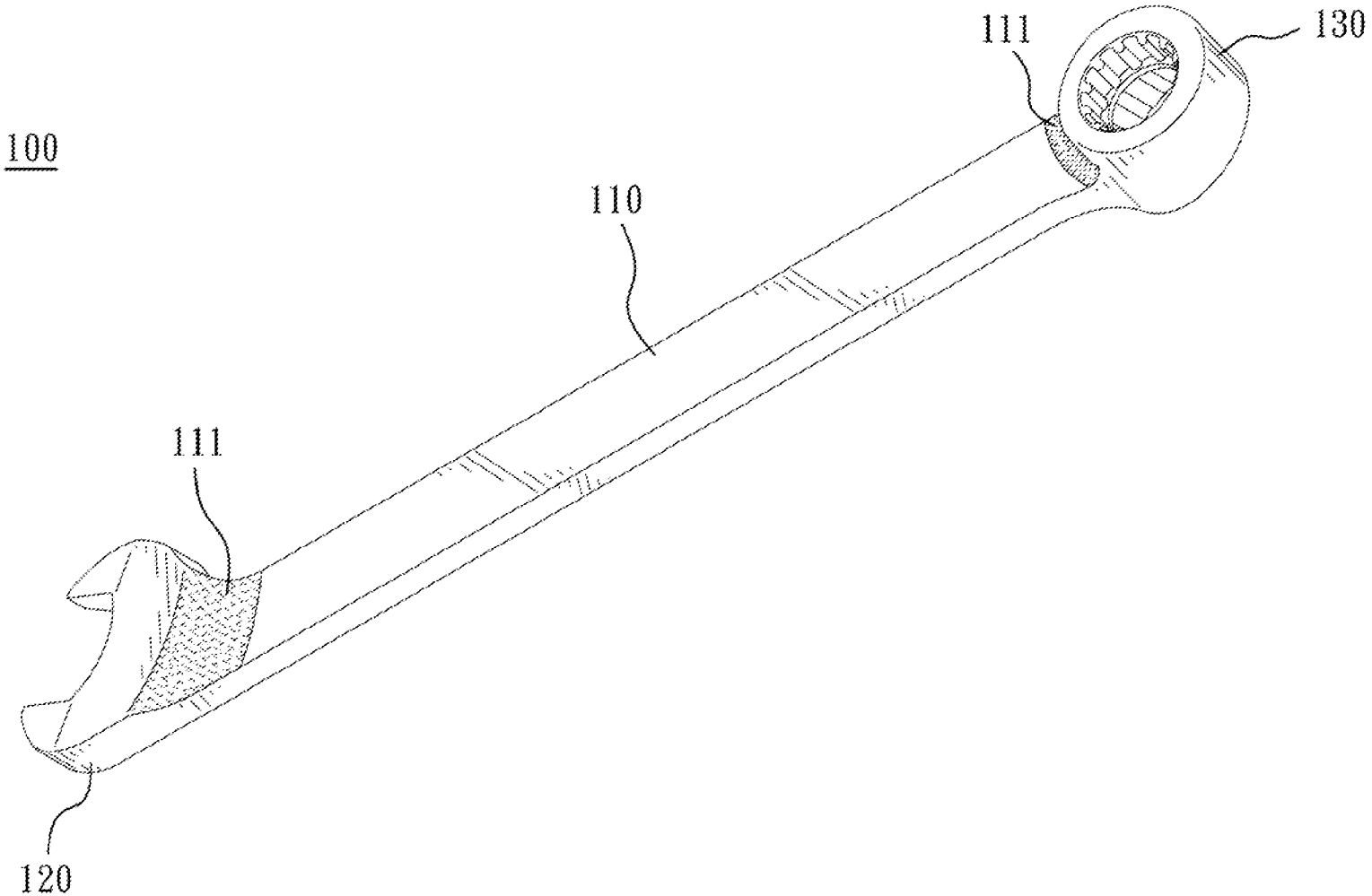
FIG. 1 is a three dimensional view of a wrench according to one embodiment of the present disclosure.

FIG. 1 is a three dimensional view of a wrench 100 according to one embodiment of the present disclosure. A wrench 100 includes a handle 110, a first driver 120, and a second driver 130. The first driver 120 and the second driver 130 are integrally connected to two ends of the handle 110.

Figure 2:
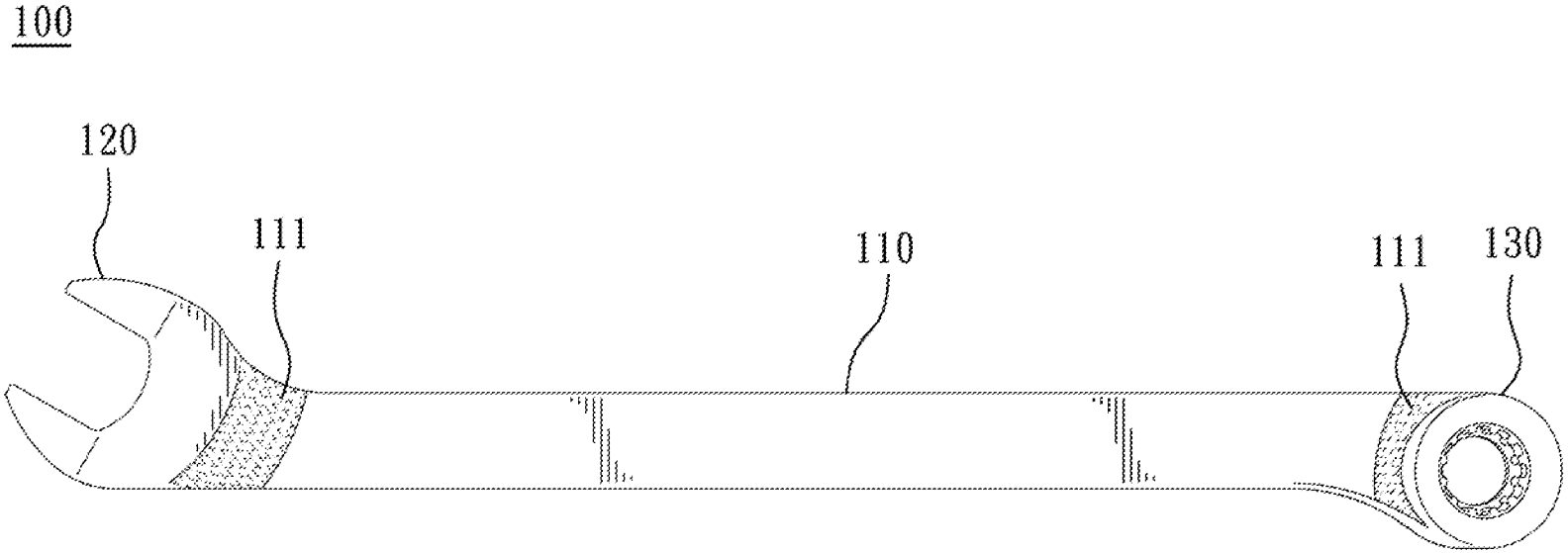
FIG. 2 is a front view of the wrench of FIG. 1.

FIG. 2 is a front view of the wrench 100 of FIG. 1. A plurality of embossments 111 are disposed at least one end of the handle 110 which is connected to the first driver 120 or the second driver 130. In FIG. 2, the embossments 111 are disposed at two ends of the handle 110, so that an anti-slip effect is obtained for performing a smoother operation.

Figure 3:
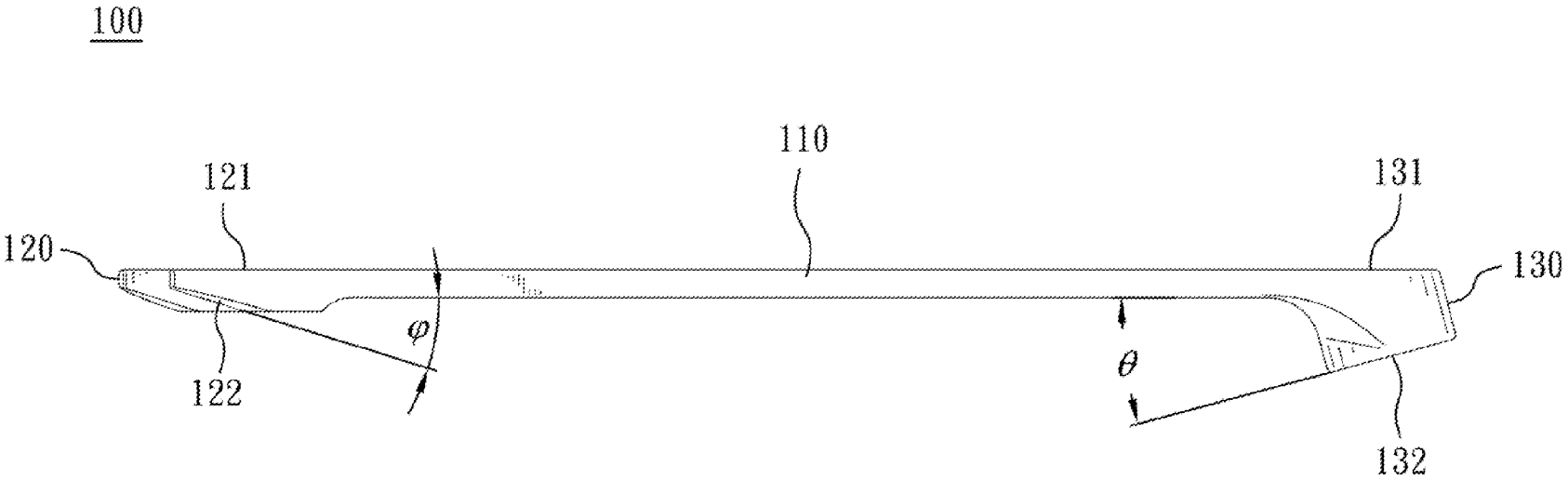
FIG. 3 is a side view of the wrench of FIG. 1.

FIG. 3 is a side view of the wrench 100 of FIG. 1. In FIG. 3, the first driver 120 includes two opening ends 121, 122; and the second driver 130 includes two opening end 131, 132. The opening end 121 of the first driver 120 and the opening end 131 of the second driver 130 are horizontally connected with the handle 110. Therefore, the wrench 100 can operate more closely to the surface of a device when being operated at the edge of the device. Thus, the first driver 120 and the second driver 130 can be engaged more tightly to a component of the device for increasing the smoothness of operation.

Furthermore, an angle φ formed between the opening end 122 of the first driver 120 and the handle 110 is from 0 degrees to 25 degrees. Compared to the horizontal connection between the opening end 121 and the handle 110, the angle φ is helpful for operating on the device which has an un-uniform surface or more components, and is favorable for adjusting the posture of handling wrench, and thereby increasing the smoothness of user's operation.

An angle θ formed between the opening end 132 of the second driver 130 and the handle 110 is from 0 degrees to 25 degrees. As the foregoing statement, the purpose of the angle θ is to increase the smoothness of user's operation.

Figure 4:
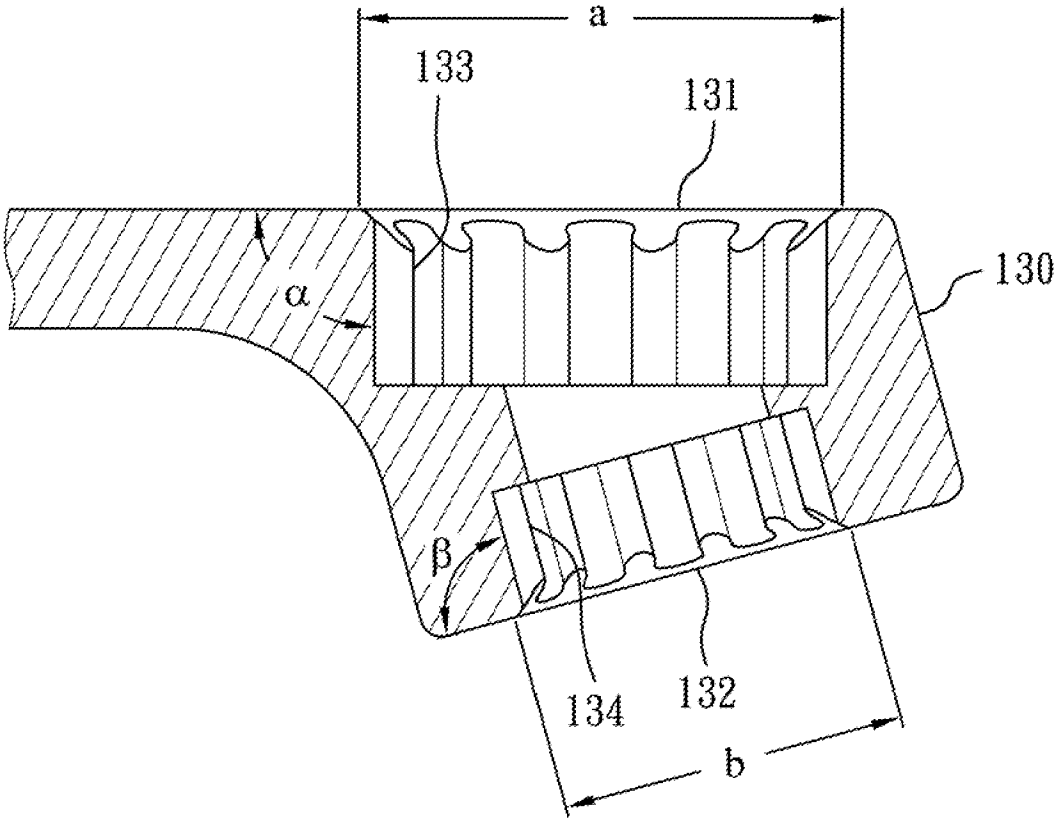
FIG. 4 is a cross-section view of the second driver of the wrench of FIG. 1.

FIG. 4 is a cross-section view of the second driver 130 of the wrench 100 of FIG. 1. In FIG. 4, the second driver 130 is hollow tube-shaped and has a plurality of first teeth 133 and a plurality of second teeth 134 located on the inner wall thereof. An angle α is formed between the first teeth 133 and the opening end 131, and an angle β is formed between the second teeth 134 and the opening end 132. The angle α and the angle β are both from 75 degrees to 150 degrees. Therefore, the opening end with different incline angles can be varied with different positions of the device, and thereby increasing the smoothness of operation.

In the embodiment of FIG. 4, the angle α and the angle β are both 90 degrees. Therefore, the first teeth 133 or the second teeth 134 can be engaged with the device more tightly for increasing the stability of operation.

According to the above statement, the present disclosure has advantages as follows:

1. The angles are formed between the handle 110 and the first driver 120, and between the handle 110 and the second driver 130. Therefore, it is favorable for adjusting the posture of the users, and thereby producing a strength-saving effect during operation.

2. The angles are formed between the teeth 133, 134 and the opening end 131, 132. Therefore, it is favorable for being applied to a driving component at different positions for increasing the application range.

3. Two ends of the handle 110 are horizontally connected to the opening end 121 of the first driver 120 and the opening end 131 of the second driver 130, and thereby increasing the smoothness of operation.

4. The embossments 111 can be disposed on two ends of the handle 110, and thereby obtaining the anti-slip effect for increasing the stability of operation.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A wrench, comprising:

a handle;

a first driver integrally connected to an end of the handle, wherein an opening end of the first driver is horizontally connected with the handle, the open end has an upper surface, and the upper surface of the open end is horizontal connected with an upper surface of the handle; and a second driver being hollow tube-shaped integrally connected to the other end of the handle, an opening end of the second driver horizontally connected to the handle, wherein the open end has an upper surface, the upper surface of the open end is horizontally connected with the upper surface of the handle, and the upper surface of the first open end, the upper surface of the second open end and the upper surface of the handle are connected to form a horizontal plan, and the second driver having a plurality of first teeth and a plurality of second teeth, wherein the first teeth and the second teeth are located on an inner wall of the second driver, an angle $\alpha$ is formed between the first teeth and the other opening end of the second driver, an angle $\beta$ is formed between the second teeth and the other opening end of the second driver, and the angle $\alpha$ and the angle $\beta$ are both from 75 degrees to 105 degrees.

2. The wrench of claim 1, wherein the angle $\alpha$between the first teeth and the opening end of the second driver is 90 degrees.

3. The wrench of claim 2, wherein the angle $\beta$ between the second teeth and the opening end of the second driver is 90 degrees.

4. The wrench of claim 1, wherein an angle $\phi$ formed between the other opening end of the first driver and the handle is from 0 degrees to 25 degrees.

5. The wrench of claim 1. wherein an angle $\theta$ formed between the opening end of the second driver and the handle is form 0 degrees to 25 degrees.

* * * * *